US007637371B2

(12) United States Patent
Kang

(10) Patent No.: US 7,637,371 B2
(45) Date of Patent: Dec. 29, 2009

(54) LIPSTICK CASE

(76) Inventor: Sungil Kang, #B-201, Adena Palace, 169-1, Jeongja-dong, Bundang-gu,Sungnam-si, Kyeonggi-do, Sungnam-si (KR) 463-834

( * ) Notice: Subject to any disclaimer, the term of this patent is extended or adjusted under 35 U.S.C. 154(b) by 6 days.

(21) Appl. No.: 12/092,876

(22) PCT Filed: Mar. 15, 2006

(86) PCT No.: PCT/KR2006/000933

§ 371 (c)(1),
(2), (4) Date: May 7, 2008

(87) PCT Pub. No.: WO2007/066855

PCT Pub. Date: Jun. 14, 2007

(65) Prior Publication Data

US 2008/0277300 A1 Nov. 13, 2008

(30) Foreign Application Priority Data

Dec. 5, 2005 (KR) ..... 20-2005-0034197

(51) Int. Cl.
*B65D 85/72* (2006.01)

(52) U.S. Cl. ..... 206/385; 401/59; 401/60; 401/68

(58) Field of Classification Search ..... 206/385; 401/59, 60, 68, 88
See application file for complete search history.

(56) References Cited

U.S. PATENT DOCUMENTS 4,973,178 A * 11/1990 Kakuta et al. ..... 401/59
5,531,318 A * 7/1996 Coleman et al. ..... 206/738
5,979,468 A * 11/1999 Blake, III ..... 132/318
6,012,863 A * 1/2000 Sakurai ..... 401/60
6,293,391 B1 * 9/2001 Kim ..... 206/77.1
6,315,479 B1 * 11/2001 Sakurai ..... 401/59

* cited by examiner

*Primary Examiner*—Ehud Gartenberg
*Assistant Examiner*—Blaine G Neway
(74) *Attorney, Agent, or Firm*—John K. Park; Park Law Firm

(57) ABSTRACT

Disclosed is a lipstick case used for makeup. According to the lipstick case of the present design, when a user rotates a rotary body (20) or an outer body (10) forming a main body, a guide projection (61) a of a lipstick holder (60) and a guide projection (51) of a lid opening tube (50) are guided respectively to a lipstick holder guide spiral groove (31) and lid opening tube guide spiral groove (32) of a rotary tube (30) pressed in the outer body (10) and at the same time, make a linear motion by a lipstick holder guide hole (41) and a lid opening tube guide hole (42) formed at a guide tube (40), whereby the lid opening tube (50) opens a lid (70). When the guide projection (51) of the lid opening tube (50) is positioned in a horizontal hole (32) a formed in extension with the lid opening tube guide spiral hole (32) of the rotary tube (30), the upward motion of the lid opening tube (50) stops whereas the lipstick holder (60) ascends a little bit further until a lipstick (80) sticks out of the lid opening tube (50).

2 Claims, 13 Drawing Sheets

[Fig. 1]
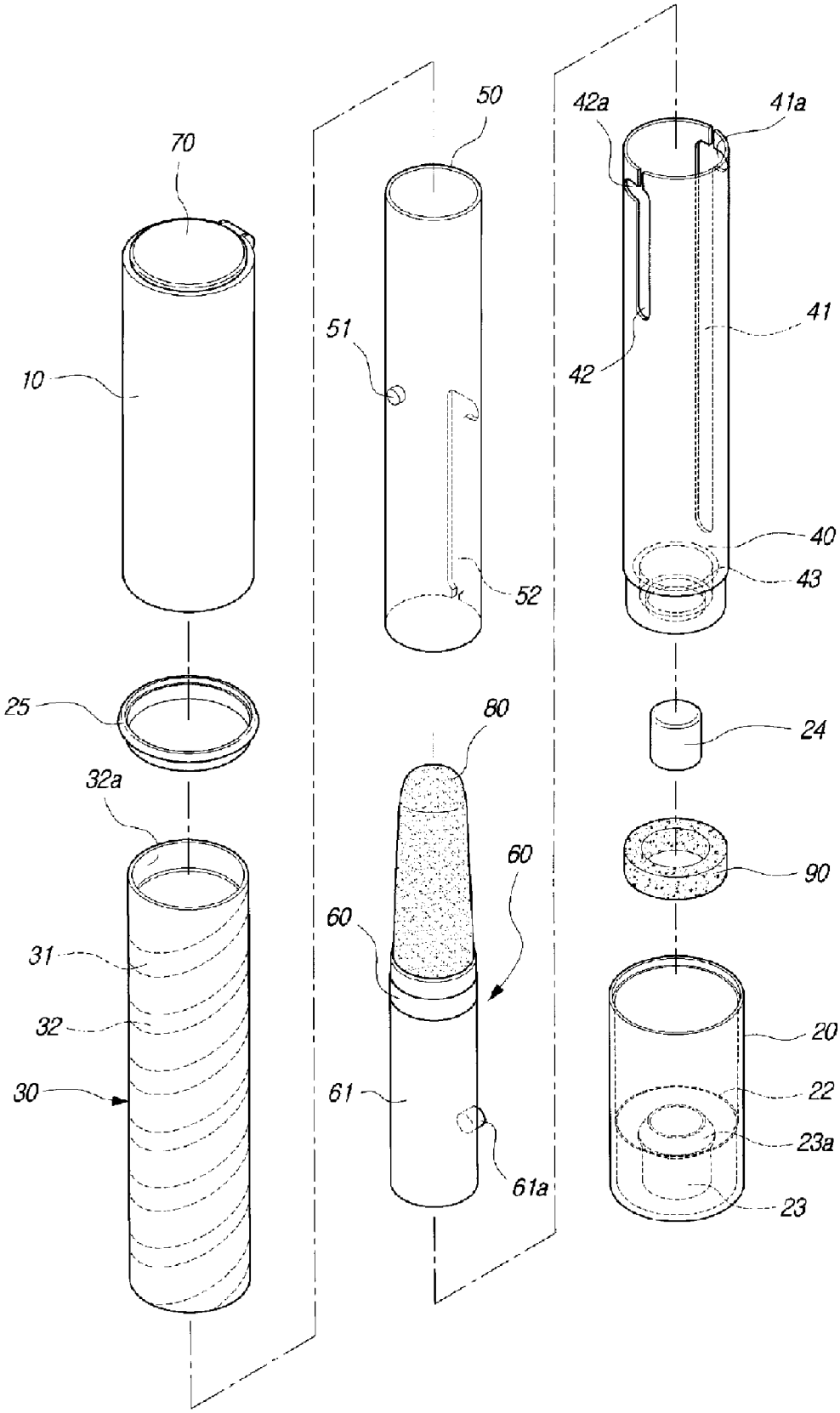

[Fig. 2]
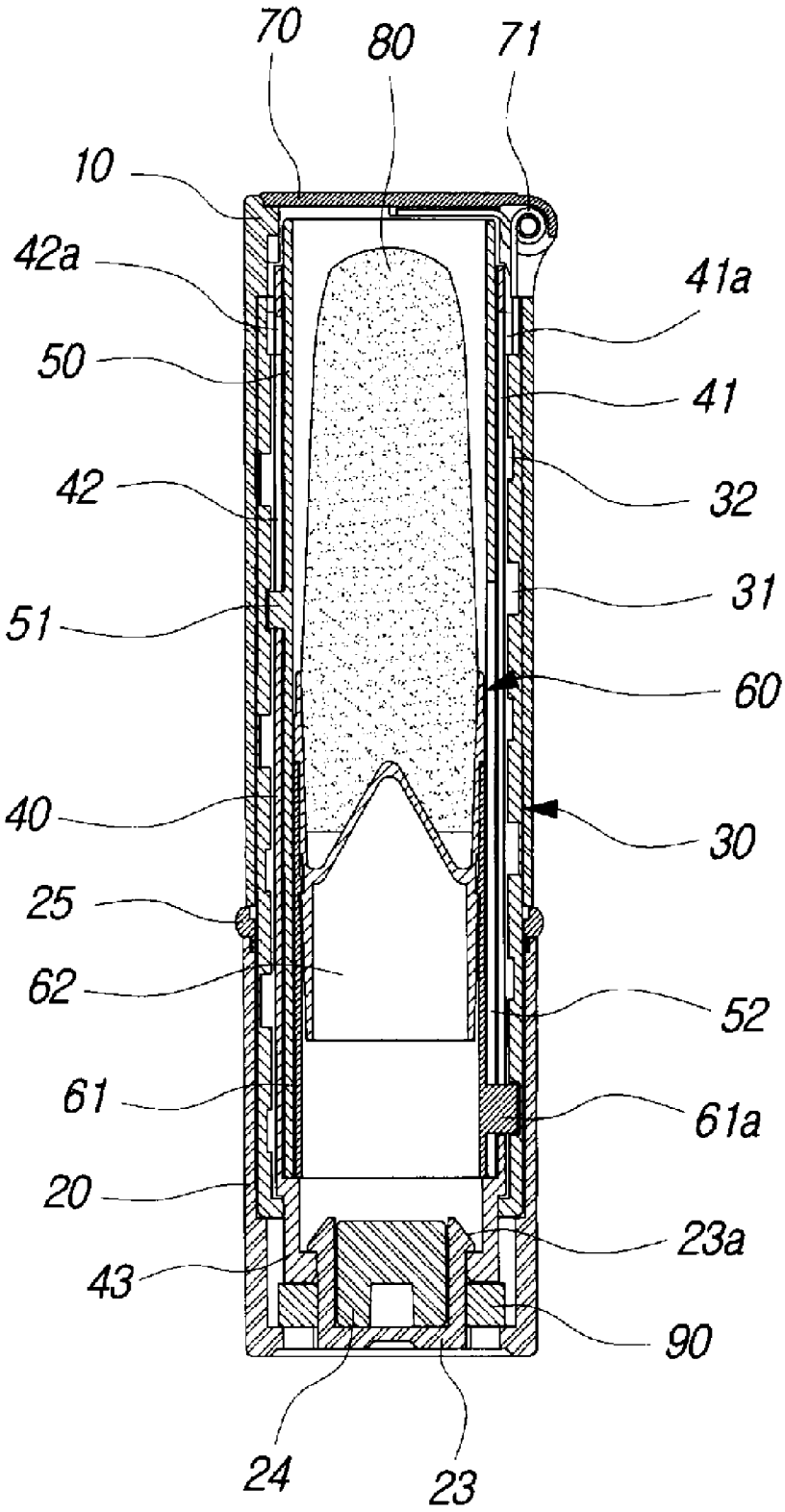

[Fig. 3]
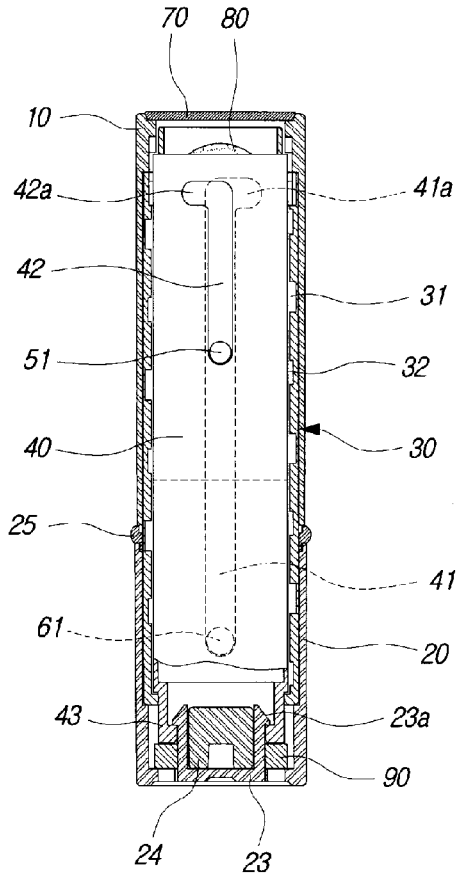
[Fig. 4]
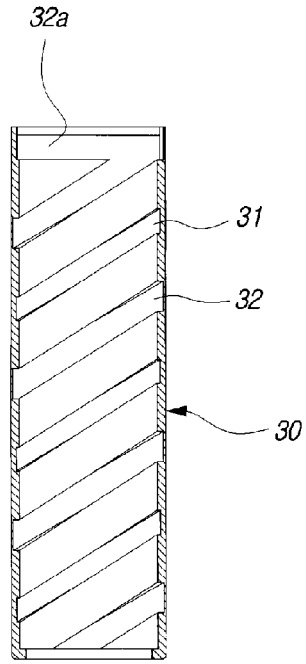

[Fig. 5]
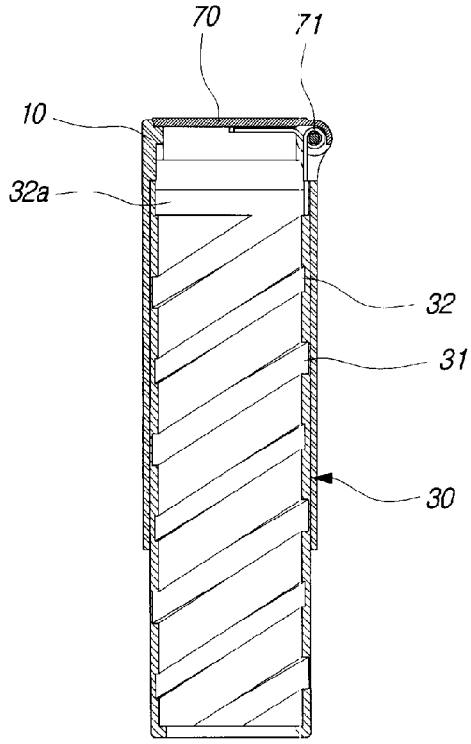
[Fig. 6]
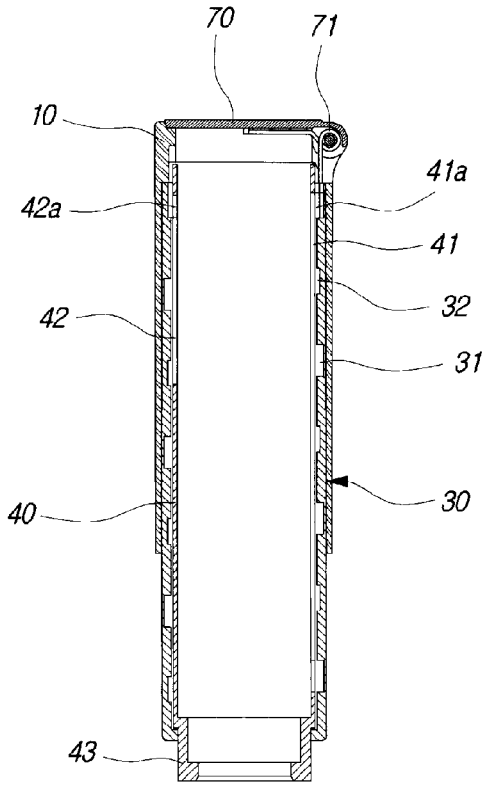

[Fig. 7]
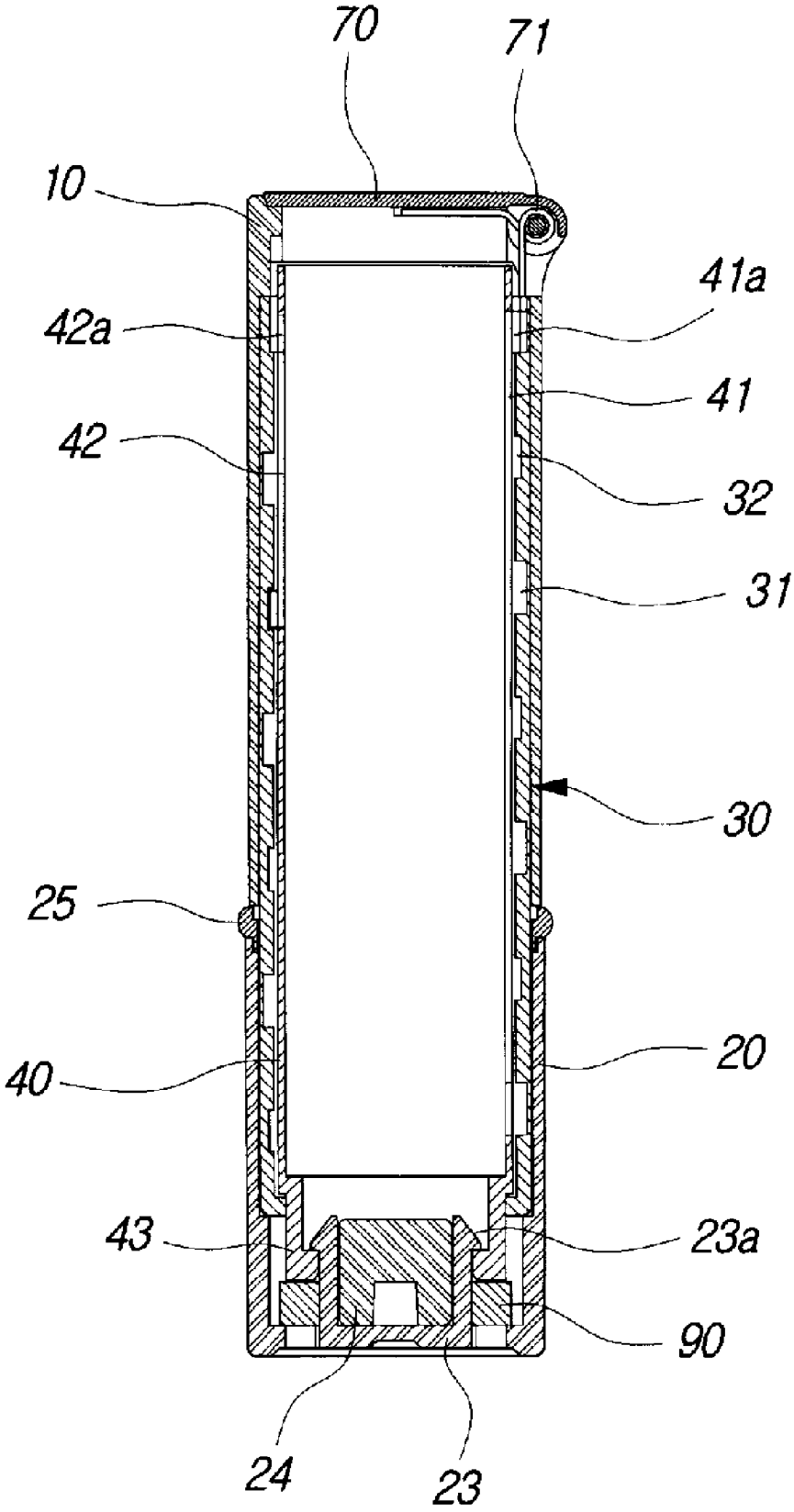

[Fig. 8]
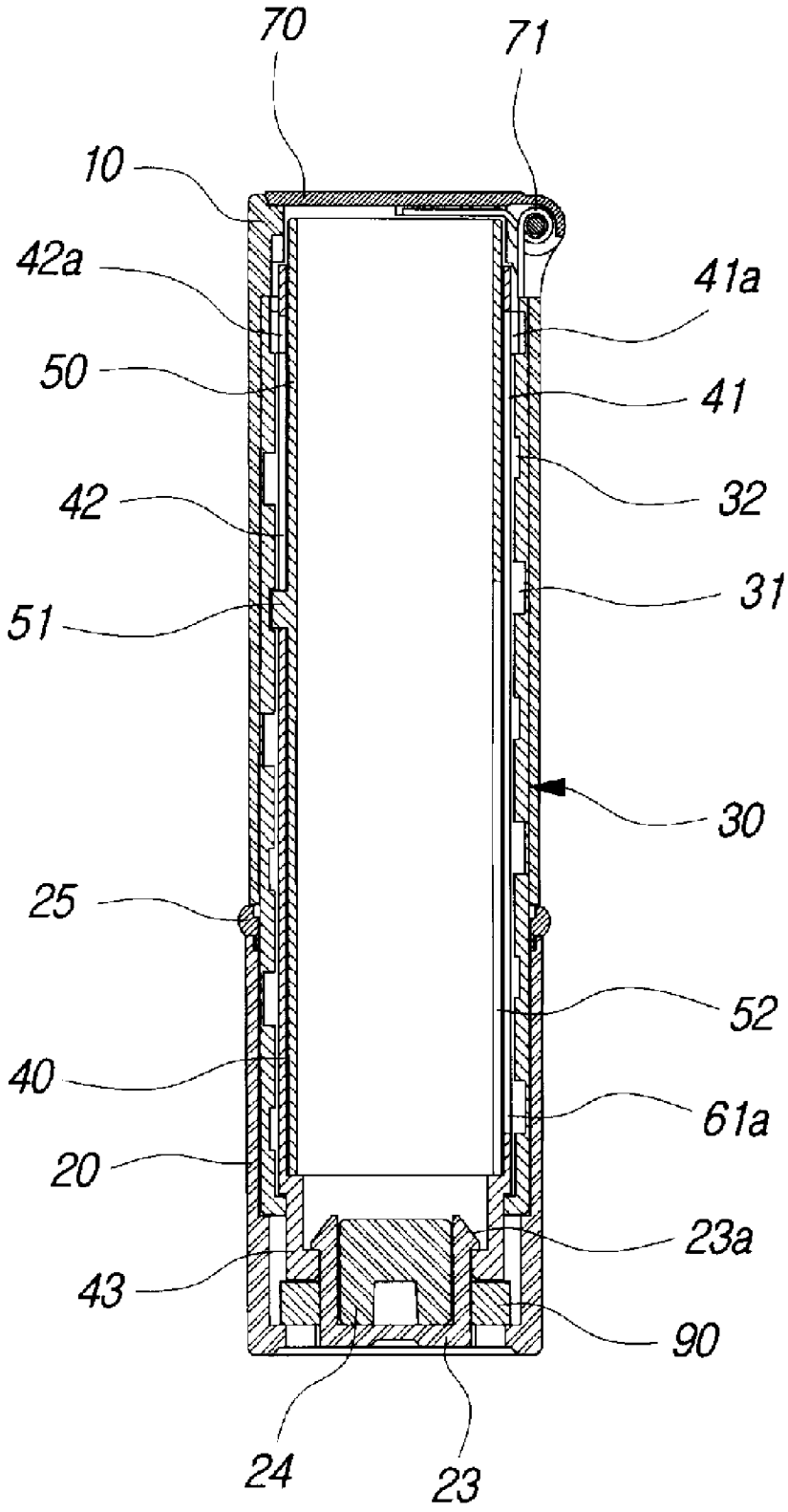

[Fig. 9]
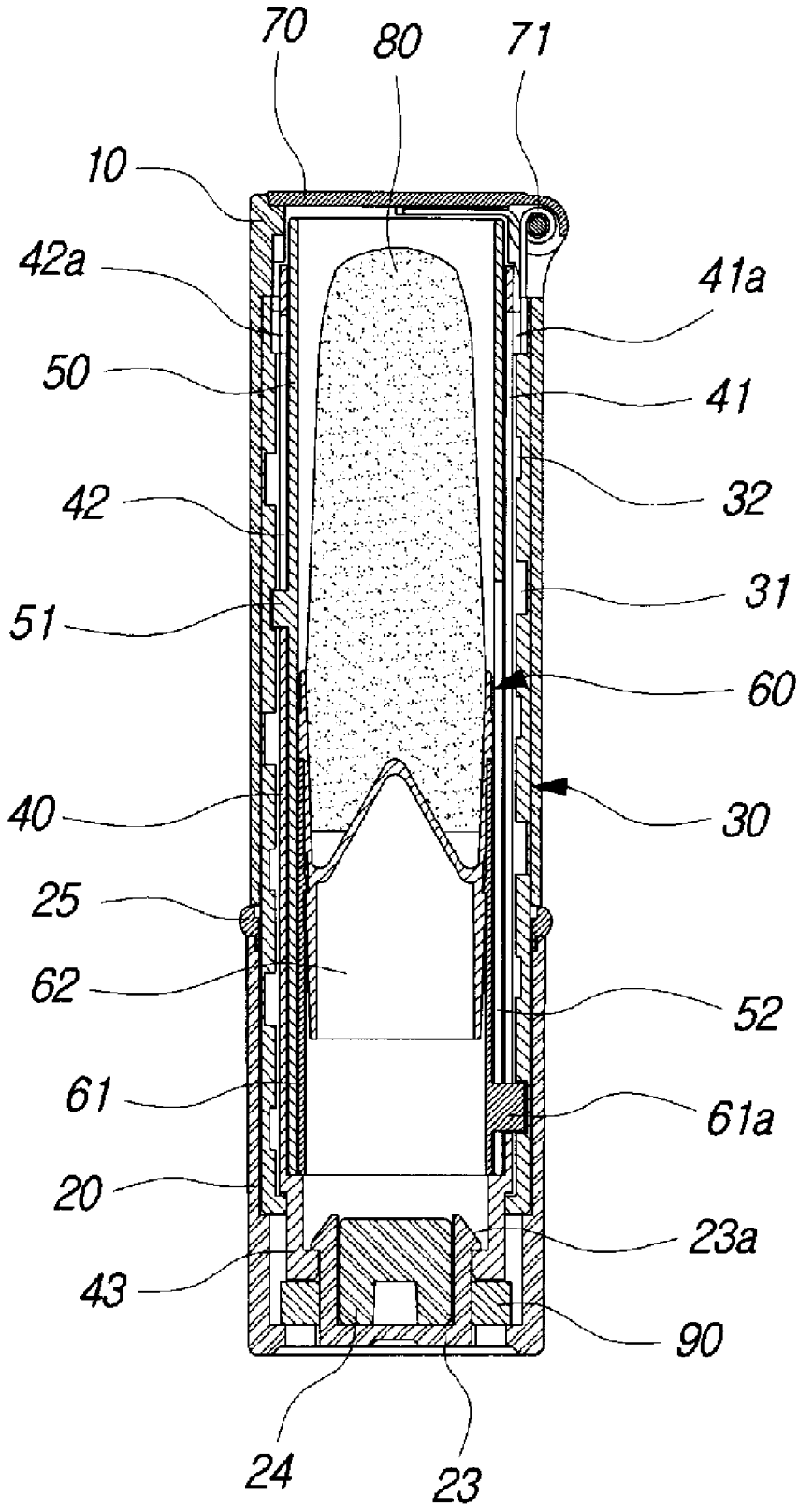

[Fig. 10]
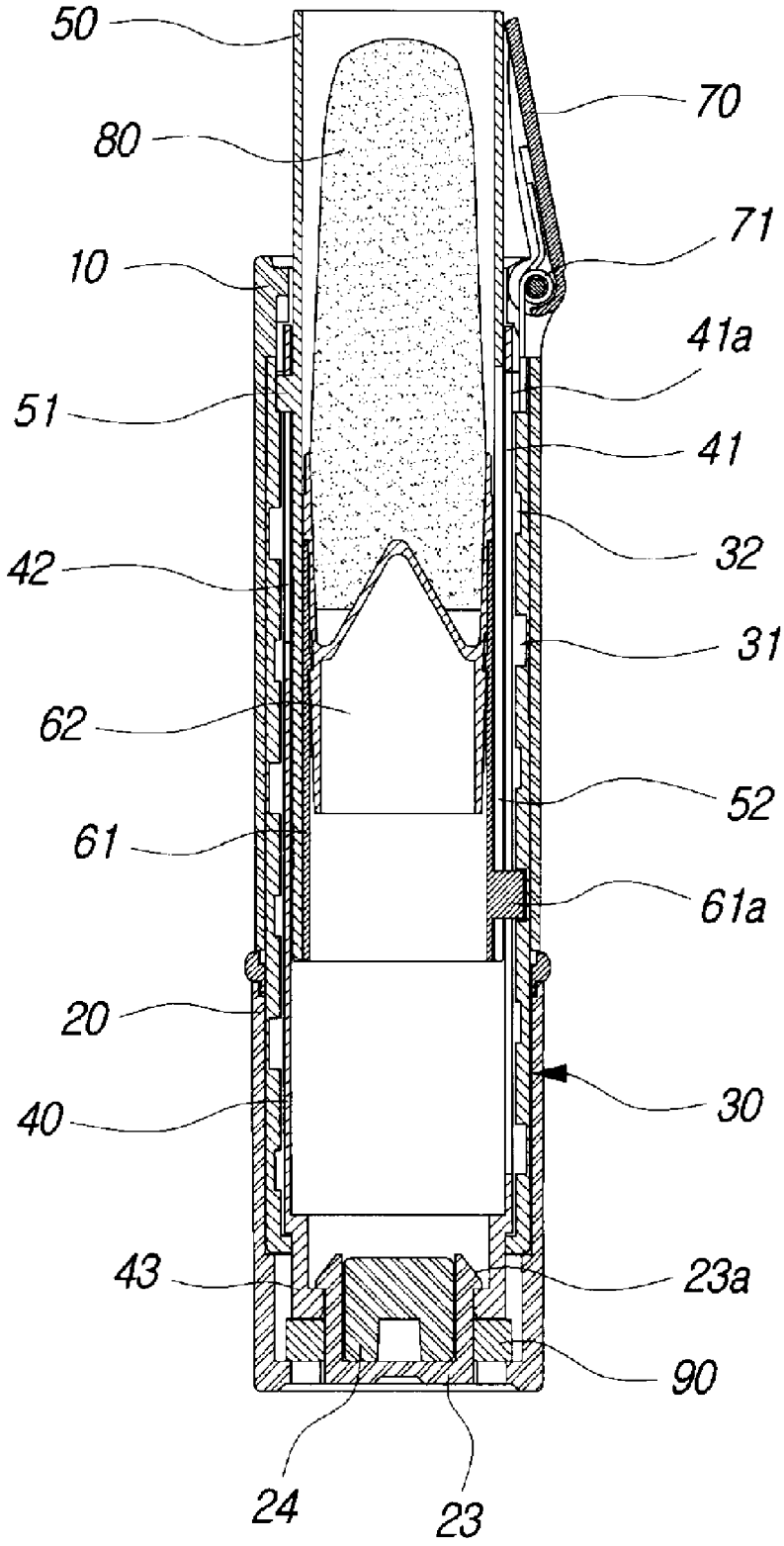

[Fig. 11]
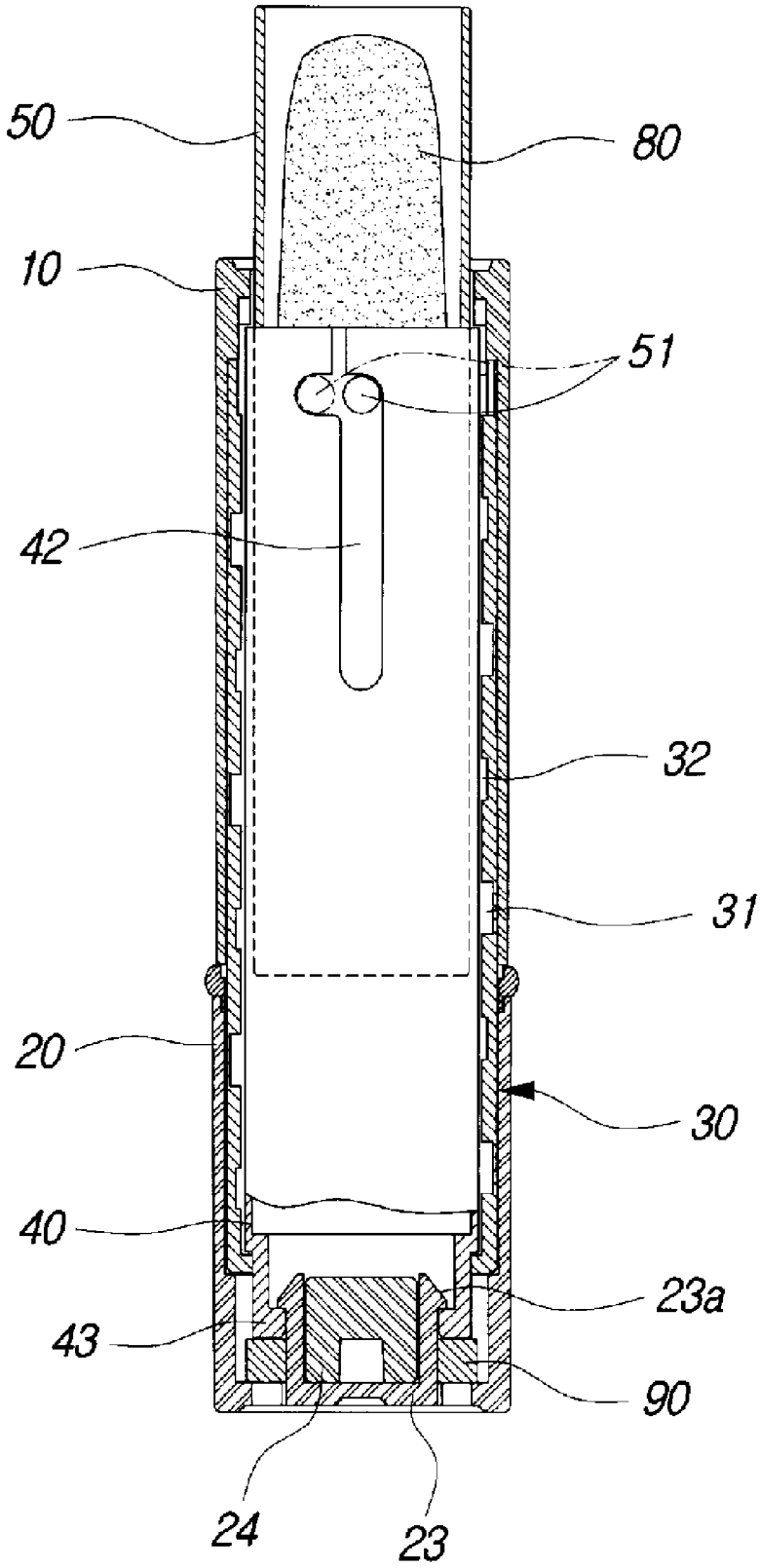

[Fig. 12]
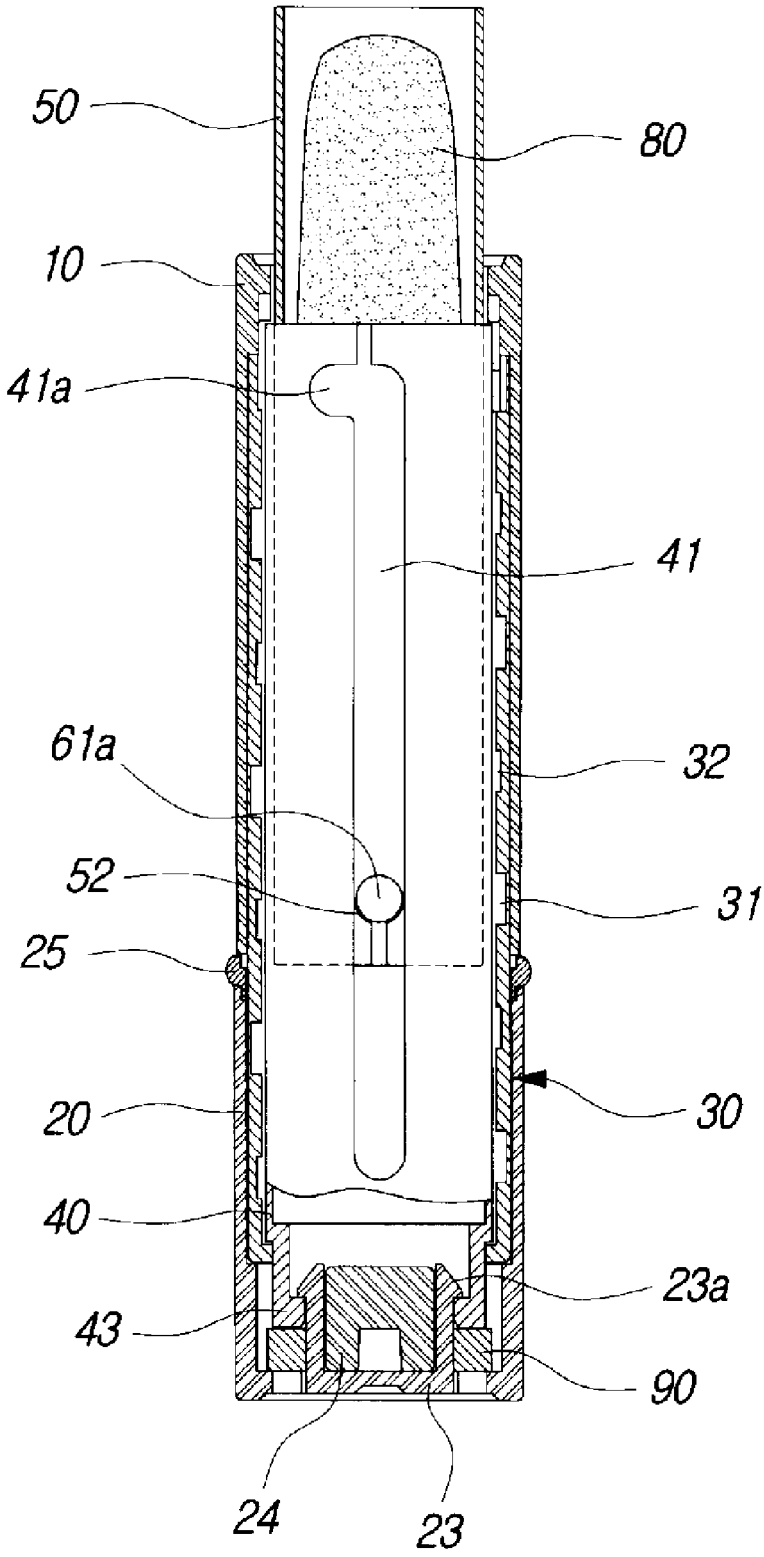

[Fig. 13]
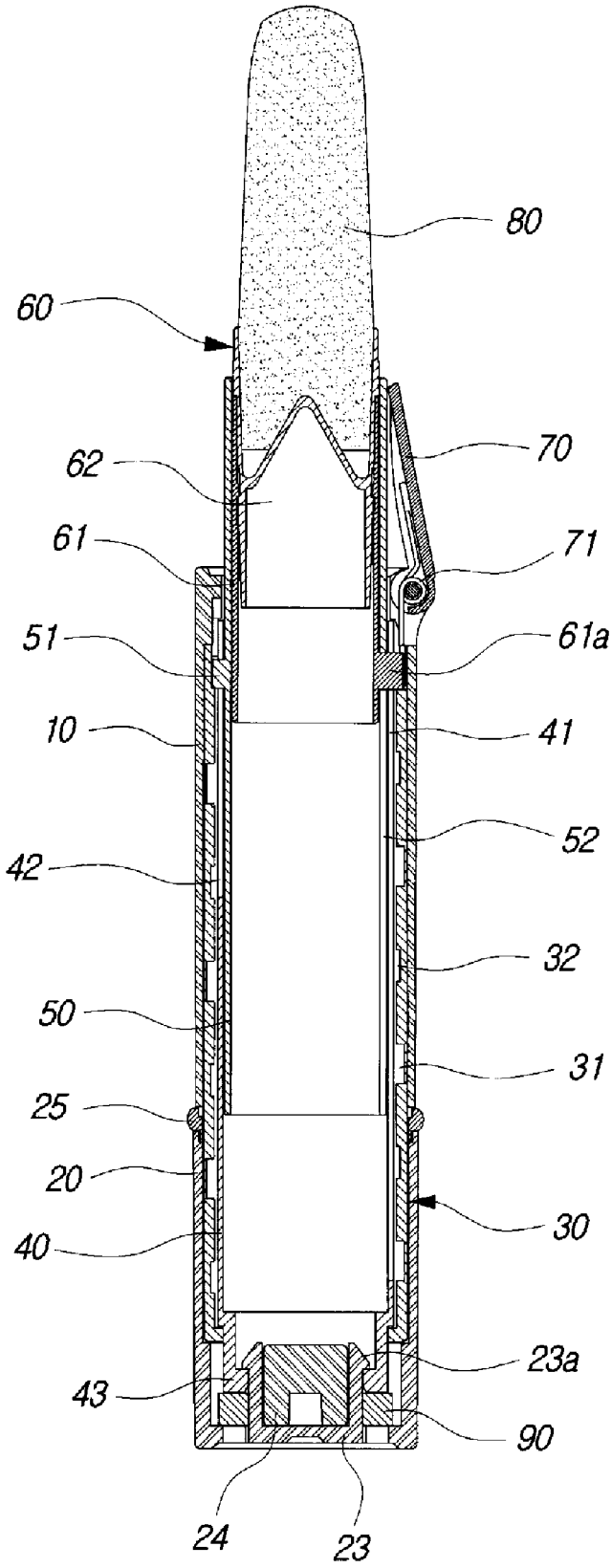

[Fig. 14]
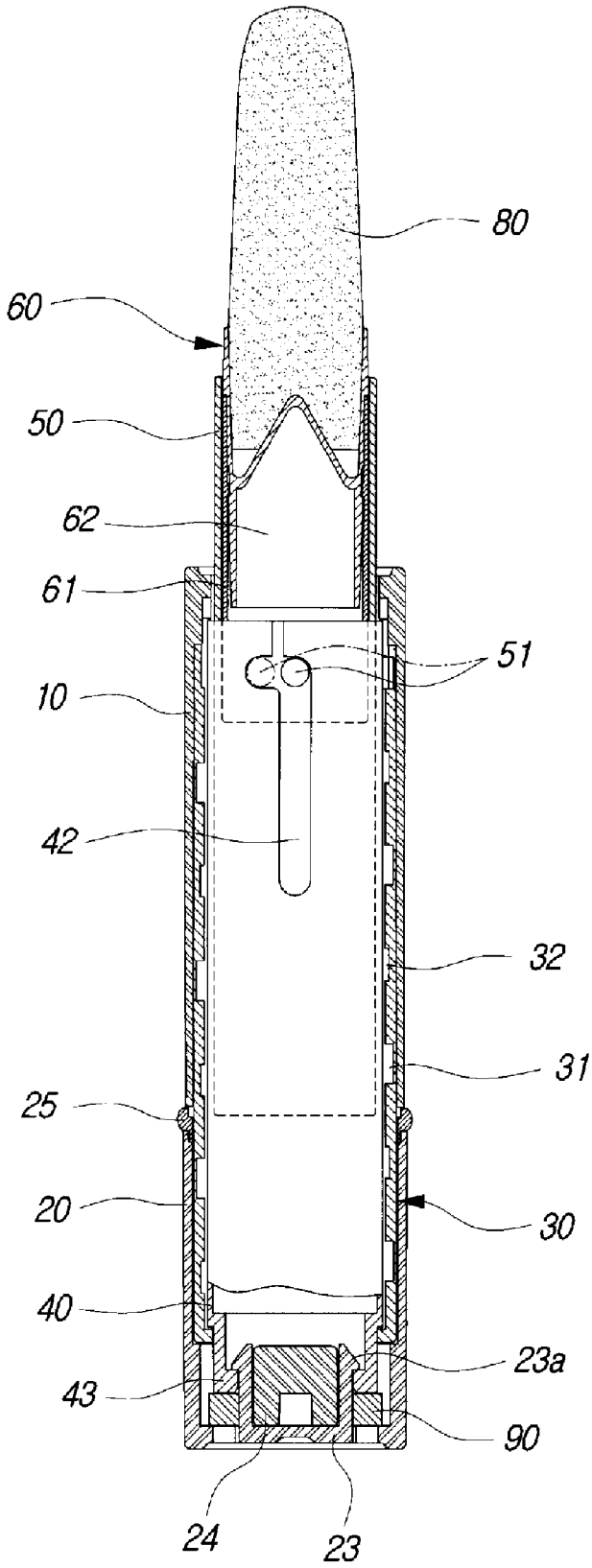

[Fig. 15]
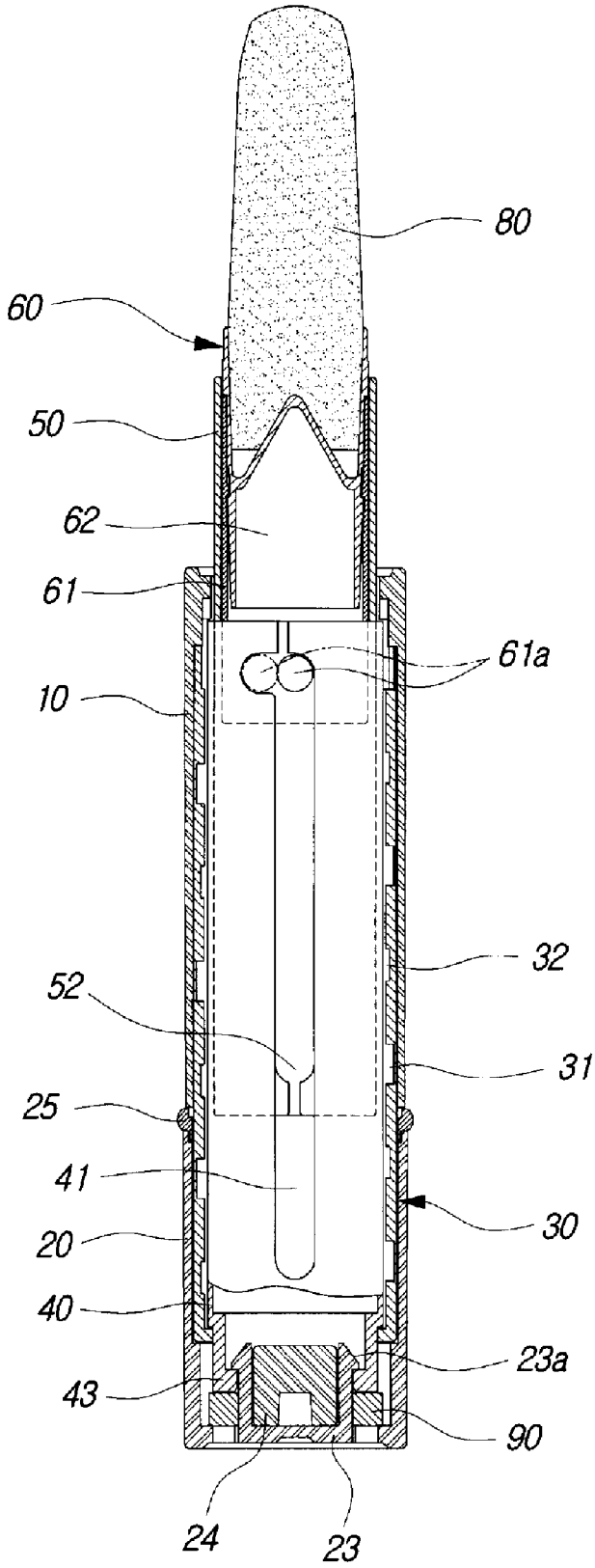

LIPSTICK CASE

TECHNICAL FIELD

The present design relates to a lipstick case for keeping lipstick for use in a makeup. More particularly, the present invention relates to an improved structure of a lipstick case for increasing user's convenience, in which a lid hinged to the upper portion of a main body of the lipstick case is first opened when the lipstick twists up, whereby a user does not need to open or close the lid as in a traditional lipstick case where a main body and a lid are separated.

BACKGROUND ART

In general, a lipstick case is constituted by a main body in which a lipstick is housed, and a lid for covering the main body to protect the lipstick.

In this traditional lipstick case, a lipstick is fixed at a lipstick holder, and a projection is formed at its circumferential surface. One side of a guide tube inserted into the main body has a guide groove in which the lipstick holder is inserted to accommodate the projection of the lipstick holder. Also, a spiral groove is formed on the inner wall of a rotary tube, and the projection of the lipstick holder is inserted into the spiral groove by combining the rotary tube with the outside of the guide tube. And, the lipstick is closed by the lid from the upper direction.

Therefore, when a user wants to put on a lipstick, she must open the lid and hold the guide tube with one hand while holding the main body with the other hand. When the main body and the guide tube are rotated in opposite directions, the projection of the lipstick holder is guided upwardly by the spiral groove of the rotary tube and by the guide groove of the guide tube. At this time, the lipstick inserted in the lipstick holder is twisted up or ascends together, allowing the user to apply the lipstick.

The above-described traditional lipstick case poses problems in that a user must open the lid from the main body to use a lipstick, and the lid separated from the main body is exposed to contamination by foreign materials and contaminates the lipstick eventually.

To resolve these problems, Korean utility model registration No. 166208 suggested a new lipstick case, in which a push button is slidably mounted on the side of the main body of a lipstick case and a lipstick holder is connected to the button by a connection band, whereby a user can push or pull the button on the slide to twist up or down a lipstick. In addition, a lid is installed in the main body in a manner that when the user twists up the lipstick, the lid is automatically opened.

Although this structure solved the inconvenience with separating a lid from the main body of a lipstick case, it caused other problems. That is, since the lid is opened by being pushed by a lipstick, it is easily stained with the lipstick. Moreover, when a user applies the lipstick on her lips, the lipstick easily slides down. Thus, the new lipstick case could not satisfy customer's need, either.

DISCLOSURE OF INVENTION

Technical Problem

Therefore, the present invention has been made in view of the above problems, and it is an object of the present invention to provide a lipstick case with an improved structure for solving the inconvenience with separating a lid from the main body of a lipstick case and for preventing the loss of a lid or the contamination of the lipstick by the lid stained with foreign substances. In detail, when a rotary tube pressed in an outer body of the main body of a lipstick case is rotated, a guide projection of a lipstick holder and a guide projection of a lid opening tube positioned respectively in a lipstick holder guide spiral groove and a lid opening tube guide spiral groove which are formed side by side on the inner surface of the rotary tube are guided. The lid opening tube opens the lid and at the same time, the guide projection of the lid opening tube is positioned in a horizontal groove formed in extension of the lid opening tube guide spiral groove. Then, the upward motion of the lid opening tube stops, while the lipstick holder ascends a little bit further until the lipstick sticks out, making the lipstick not interfered with the lid. Moreover, the structure of a rotary body is improved to make the guide tube assemble in the rotary body more closely, so that no floating occurs when a user raises the lipstick from the tube or operating noises due to the floating are not generated. Further, by forming only a single guide projection to be guided to the lipstick holder guide spiral groove and the lid opening tube guide spiral groove, respectively, assemblability can be improved.

Technical Solution

In accordance with an aspect of the present design, the above and other objects can be accomplished by the provision of a lipstick case with a convenient structure. According to the lipstick case of the present design, when a user rotates a rotary body 20 or an outer body 10 forming a main body, a guide projection 61*a* of a lipstick holder 60 and a guide projection 51 of a lid opening tube 50 are guided respectively to a lipstick holder guide spiral groove 31 and lid opening tube guide spiral groove 32 of a rotary tube 30 pressed in the outer body 10 and at the same time, make a linear motion by a lipstick holder guide hole 41 and a lid opening tube guide hole 42 formed at a guide tube 40, whereby the lid opening tube 50 opens a lid 70. When the guide projection 51 of the lid opening tube 50 is positioned in a horizontal hole 32*a* formed in extension with the lid opening tube guide spiral hole 32 of the rotary tube 30, the upward motion of the lid opening tube 50 stops whereas the lipstick holder 60 ascends a little bit further until a lipstick 80 sticks out of the lid opening tube 50.

Advantageous Effects

As explained before, the lipstick case according to the present design can solve the inconvenience with separating a lid from the main body of a lipstick case and for preventing the loss of the lid 70 or the contamination of the lipstick 80 by the lid 70 stained with foreign substances. In detail, when the rotary tube 30 rotates by the rotation of the rotary body 20 or the outer body 10 of the main body in opposite directions, the guide projection 61*a* of the lipstick holder 60 and the guide projection 51 of the lid opening tube 50 are guided respectively to the lipstick holder guide spiral groove 31 and the lid opening tube guide spiral groove 32 which are formed side by side on the inner surface of the rotary tube 30 are guided. This makes the lid opening tube 50 open the lid 70 and at the same time, the guide projection 51 of the lid opening tube 50 is positioned in the horizontal groove 32*a* formed in extension of the lid opening tube guide spiral groove 32. Then, the upward motion of the lid opening tube 50 stops, while the lipstick holder 60 ascends a little bit further until the lipstick 80 sticks out, preventing the lipstick 80 from interfering with the lid 70. Moreover, the structure of the rotary body 20 is improved to make the guide tube 40 assemble in the rotary body 20 more closely, so that no floating occurs when a user raises the lipstick 80 from the tube or operating noises due to the floating are not generated. Further, by forming only a single guide projection to be guided to the lipstick holder guide spiral groove 31 and the lid opening tube guide spiral groove 32, respectively, assemblability can be improved.

BRIEF DESCRIPTION OF THE DRAWINGS

The above and other objects, features and other advantages of the present invention will be more clearly understood from the following detailed description taken in conjunction with the accompanying drawings, in which:

FIG. 1 is an exploded perspective view of a lipstick case according to the present design;

FIG. 2 and FIG. 3 are cross-sectional views of a lipstick tube of the present design being combined;

FIG. 4 is a cross-sectional view showing a rotary tube excerpted from the present design;

FIG. 5 to FIG. 9 are diagrams showing an example of the assembly procedure of a lipstick case according to the present design;

FIG. 10 illustrates a cross-sectional view of a lipstick case of the present design, in which a lid opening tube opened a lid at the result of the rotation of a rotary body;

FIG. 11 is a partial cross-sectional view taken from line A-A of FIG. 10;

FIG. 12 is a rear view of FIG. 11, in which a guide projection of a lipstick holder is positioned at a guide hole formed on a lid opening tube having been ascended to open a lid;

FIG. 13 illustrates a cross-sectional view of a lipstick case of the present design with a lipstick stuck out of a lid opening tube at the result of the rotation of a rotary body;

FIG. 14 is a partial cross-sectional view taken along line B-B of FIG. 13; and FIG. 15 is a real view of FIG. 14, in which a guide projection of a lipstick holder is positioned at a guide hole of a lid opening tube as a lipstick sticks out of a tube.

MODE FOR THE INVENTION

A preferred embodiment of the present design is explained hereinafter with accompanying drawings.

As shown in FIGS. 1 to 15, a lipstick case according to the present design includes an outer body 10 to which a lid 70 for protecting a lipstick 80 form foreign substances is hinged; a rotary tube 30 pressed in the outer body 10, operating together with the outer body 10; a guide tube 40 passing through the rotary tube 30 for guiding a lipstick holder 60 and a lid opening tube 50 to move linearly; a rotary body 20, which is combined with the lower portion of the guide tube 40 through the medium of a short tube 32*a*, thereby operating together with the guide tube 40, and which is loosely inserted to the lower portion of the rotary tube 30; a lid opening tube 50 formed inside the guide tube 40 for opening the lid 70; and a lipstick holder 60, which is positioned inside the lid opening tube 50 and on which the lipstick 80 is mounted.

The outer body 10 is hinged to the lid 70 to prevent the contamination of the lipstick 80 by foreign substances.

The lid 70 receives an elastic force of a spring 71 to make sure that it always maintains the closed state with respect to the outer body 10.

The rotary tube 30 pressed in the outer body 10 has a lipstick holder guide screw groove 31 to which a guide projection 61*a* formed on a combining body 61 of the lipstick holder 60 is guided, and a lid opening tube guide spiral groove 32 to which a guide projection 51 of the lid opening tube 50 is guided formed side by side. Also, on the upper portion of the lid opening tube guide spiral groove 32 is a horizontal groove 32*a* formed in extension of the lid opening tube guide spiral groove 32.

The guide tube 40 passing through the rotary tube 30 has a long lipstick holder guide hole 41 formed one side, to which the guide projection 61*a* formed on the combining body 61 of the lipstick holder 60 is guided, a lid opening tube guide hole 42 formed on the opposite side starting from the center to the upper side, to which the guide projection 51 of the lid opening tube 50 is guided, and a fixing frame 43 whose lower end is fixed at a jaw 23*a* formed at the short tube 23*a* of the rotary body 20.

Fixing grooves 41*a* and 42*a* to which the guide projection 61*a* of the lipstick holder 60 and the guide projection 51 of the lid opening tube 50 are fixed are formed on the upper portion of the lipstick holder guide hole 41*a* and the lid opening tube guide hole 42, respectively.

The rotary body 20 combined with the lower portion of the guide tube 40 has the short tube 23 including the jaw 23*a*, on which the fixing frame 43 of the guide tube 40 is suspended, formed at the center on the inner side of the lower portion, and a support jaw 22, on which the lower end of the rotary tube 30 is supported, formed on the inner side. The side wall of the rotary body 20 maintains a loosen state with respect to the rotary tube 30.

A cushion ring 90 made from hard or solid materials is installed at the out side of the short tube 23 of the rotary body 20 to make the lower end portion of the guide tube 40 maintain its fixed state in a close connection with respect to the rotary body 20, and a weight block 24 is installed inside the short tube 23.

The lid opening tube 50 installed inside the guide tube 40 for opening the lid 70 has the guide projection 51 formed at the center of the outer side, and the guide hole 52 formed at the lower portion opposite to the guide projection 51. The guide projection 51 is guided to the lid opening tube guide hole 42 of the guide tube 40 so that the lid opening tube 40 can move along the lid opening tube guide spiral groove 32 of the rotary tube 30 and makes a linear movement without rotation. Also, the guide projection 61*a* of the lipstick holder 60 is guided and passes through the guide hole 52.

The lipstick holder 60 placed inside the lid opening tube 50 is constituted by a dish 62 on which the lipstick 80 is mounted, and the combining body 61 fastened on the dish 62. It is this combining body 61 where the guide projection 61*a*, which is guided to the lipstick holder guide hole 41 of the guide tube 40 to cause the lipstick holder 60 to move along the lipstick holder guide spiral groove 31 of the rotary tube 30 and at the same time to make a linear motion without rotation, is formed.

To assemble the lipstick tube having the above-described constitution, as shown in FIG. 5, the rotary tube 30 is pressed in the outer body 10 that is hinged to the lid 70 for protecting the lipstick 80 from foreign substances.

Next, as shown in FIG. 6, the guide tube 40 used for making the lid opening tube 5 and the lipstick holder 60 move linearly is installed inside the rotary tube 30 which is pressed in the outer body 10 and which operates (rotates) together with the outer body 10.

The guide tube 40 is rotatably installed inside the rotary tube 30, and the lower portion of the rotary tube 30 is supported onto the jaw having the fixing frame 43.

After the guide tube 40 is assembled in the rotary tube 30, the rotary body 21 is assembled to the guide tube 40.

Before assembling the rotary body 20 with the guide tube 40, the cushion ring 90 is installed on the outside of the short tube 23 of the rotary body 20, and the weight block 24 is installed inside the short tube 23.

Later, while a sliding ring 25 is disposed at the upper portion of the side wall of the rotary body 20, the lower portion of the guide tube 40 is inserted into the short tube 23 so that the fixing frame 43 formed at the lower portion of the guide tube 40 can be suspended by the jaw 23*a* of the short tube 23.

Therefore, as shown in FIG. 7, the guide tube 40, which is assembled onto the rotary body 20 using the short tube 23 as a medium, is in a close connection by the cushion ring 90 installed on the outside of the short tube 23.

Meanwhile, the lower portion of the guide tube 40 is supported by the support jaw 22 formed on the inner side of the rotary body 20 assembled in the guide tube 40 and at the same time its side wall maintains a loosen state with respect to the circumferential surface of the rotary tube 30.

The lid opening tube 50 is installed inside the guide tube 40 having the rotary body 20 assembled therein. To this end, the guide projection 51 formed from the center to the upper direction of the outer side is inserted into the lid opening tube guide hole 42 of the guide tube 40.

At this time, the guide hole 52 formed at the lower portion opposite to the guide projection 51 is side by side with the lipstick holder guide hole 41 of the guide tube 40.

When the guide projection 51 is inserted into the lid opening tube guide hole 42 of the guide tube 40, the upper portion of the lid opening tube guide hole 42 is cut off to make the assembly of the guide projection 51 easy.

The guide projection 51 of the lid opening tube 50 inserted into the lid opening tube guide hole 42 of the guide tube 40 is positioned at the lid opening tube guide spiral groove 32 of the rotary tube 30, as shown in FIG. 8.

Lastly, after the assembly of the lid opening tube 50 in the guide tube 40 is completed, the lipstick holder 60 is assembled in the lid opening tube 50, as shown in FIG. 9. In this manner, the lipstick case of the present design is finished.

In case of assembling the lipstick holder 60 inside the lid opening tube 50, the guide projection 61*a* formed in the combing body 61 of the lipstick holder 60 should pass through the guide hole 50 formed at the lower side of the lid opening tube 50 and at the same time it is positioned at the lipstick guide spiral groove 31 of the rotary tube 30.

When a user wants to put on the lipstick 80, she simply needs to hold the outer body 10 with one hand and the rotary body 20 with the other hand, and rotate the rotary body 20 and the outer body 10 in opposite directions from each other, so as to expose the lipstick 80 from the lid opening tube 50.

FIGS. 10 to 12 illustrate a state where the lid 70 is opened. This is done by rotating the rotary body 20 or the outer body 10. When either one is rotated, the rotary tube 30 pressed in the outer body 10 rotates along the outer body 10.

When the rotary tube 30 rotates, the guide projection 61*a* of the lipstick holder 60 disposed at the broad lipstick holder guide spiral groove 31 and the guide projection 51 of the lid opening tube 50 disposed at the lid opening tube guide spiral groove 32 are guided simultaneously, and the lipstick holder 60 and the lid opening tube 50 move upwardly together.

The guide projection 61*a* of the lipstick holder 60 and the guide projection 51 of the lid opening tube 50 are guided to the lipstick holder guide hole 41 and the lid opening tube guide hole 42 formed in the guide tube 40, respectively, and make a linear motion without rotating.

Thus, when the lipstick holder 60 and the lid opening tube 50 are lifted together, the lid opening tube 50 pushes the lid 70 up and opens the lipstick case.

The lid opening tube 50 stops its upward motion when the guide projection 51 is positioned at the upper portion of the lid opening tube guide hole 42 of the guide tube 40 as shown in FIG. 11 and at the same time at the horizontal groove 32*a* that is formed in extension of the lid opening tube guide spiral groove 32 of the rotary tube 30, and rotates at the same position instead. On the other hand, the lipstick holder 60 ascends a little bit further.

The lipstick holder 60 can make the upward motion further because the guide projection 61*a* of the lipstick holder 60 disposed at the guide hole 52 of the lid opening tube 50 is positioned below as shown in FIG. 12.

FIGS. 13 to 15 illustrate a procedure how the lipstick 80 mounted on the dish 62 of the lipstick holder 60 is exposed. Even after the lid opening tube 50 stopped its upward motion, if one of the rotary body 20 or the outer body 10 is rotated by the user, the guide projection 61*a* of the lipstick holder 60 passes through the guide hole 52 of the lid opening tube 50 and reaches the lipstick holder guide hole 41 of the guide tube 40, and moves further along the lipstick holder guide spiral groove 31 of the rotary tube 30.

Therefore, as shown in FIG. 12, the guide projection 61*a* of the lipstick holder 60 disposed at the lower portion of the guide hole 52 of the lid opening tube 50 is now placed not only at the upper portion as shown in FIG. 15 but also at the upper portion of the long lipstick holder guide groove 41 of the guide tube 40 as shown in FIGS. 13 to 15.

The guide projection 61*a* of the lipstick holder 60 disposed at the upper portion of the lipstick holder guide groove 41 of the guide tube 40 is positioned at the suspension groove 41*a*, so it is not easily pushed down when the user applies the lipstick 80 on her lips.

If the user wants to put the lipstick 80 back in the lipstick tube, she rotates the rotary body 20 or the outer body 10 in the opposite direction of the direction she used to expose the lipstick 80 and lets the lipstick 80 housed in the lid. In detail, the lipstick holder 60 comes down first and the lipstick 80 is positioned inside the lid opening tube 5.

At this time, the guide projection 61*a* of the lipstick holder 60 is positioned at the guide hole 52 of the lid opening tube 50. In this state, if the user rotates or twists the rotary body 20 or the outer body 10 a little bit further, a force pulling the lid opening tube 50 down is created and as a result, the guide projection 51 of the lid opening tube 50 having been at the horizontal groove 32*a* of the rotary tube 30 starts moving along the lid opening tube guide spiral groove 32 of the rotary tube 30.

Therefore, when the lid opening tube 50 is led in, the guide projection 61*a* of the lipstick holder 60 and the guide projection 51 of the lid opening tube 50 are simultaneously guided to the lipstick holder guide spiral groove 31 and lid opening tube guide spiral groove 32 of the rotary tube 30, respectively.

As described above, when the lid opening tube 50 is led in the outer body 10 while the lipstick holder 60 is being led in the lid opening tube 50, the lid 70 hinged to the outer body 10 covers and protects the outer body 10 by the elastic force of the spring 71.

Once the lipstick 80 is safely led in the tube, the user may put the lipstick case in a case or on a dressing table. Since the lipstick case of the present design has the weight block 24 inside the short tube 23, it can stand and lie more stably.

INDUSTRIAL APPLICABILITY

Therefore, the lipstick case according to the present design can be conveniently used since a user does not need to open or close the lid as in a traditional lipstick case where a main body and a lid are separated.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A lipstick case, comprising:

an outer body to which a lid for protecting a lipstick form foreign substances is hinged;

a rotary tube pressed in the outer body, operating together with the outer body; a guide tube passing through the rotary tube for guiding a lipstick holder and linearly moving a lid opening tube;

a rotary body, which is combined with a lower portion of the guide tube through the medium of a horizontal groove, thereby operating together with the guide tube and which is loosely inserted to a lower portion of the rotary tube; wherein the rotary body comprises a short tube formed on an inner bottom surface provided with a jaw on which a fixing frame formed at a lower end of the guide tube is suspended, and a weight block is installed inside the short tube; and wherein a side wall having a support jaw formed thereon is loosely formed with respect to the circumferential wall of the rotary tube;

a lid opening tube, which is formed inside the guide tube for opening the lid, and which has a guide hole into which a guide projection of a lipstick holder is inserted and a guide projection formed at the center opposite of the guide hole for being guided to a lid opening tube guide spiral groove; and a lipstick holder, which is positioned inside the lid opening tube, and which has a dish on which the lipstick is mounted and a combining body including the guide projection of the lipstick holder to be guided to a lipstick holder guide spiral groove of the rotary tube.

2. The lipstick case according to claim 1, wherein the guide tube and the rotary body are in a close connection by means of a cushion ring installed on the short tube.

* * * * *